US010605526B2

(12) United States Patent
DeCourcy

(10) Patent No.: US 10,605,526 B2
(45) Date of Patent: Mar. 31, 2020

(54) PORTABLE ELECTROMAGNETIC WAVE DRYING APPARATUS AND METHOD FOR IN-SITU DRYING OF STRUCTURAL MEMBERS IN WOOD-FRAME CONSTRUCTION

(71) Applicant: Kathryn Grace DeCourcy, Houston, TX (US)

(72) Inventor: Kathryn Grace DeCourcy, Houston, TX (US)

( * ) Notice: Subject to any disclaimer, the term of this patent is extended or adjusted under 35 U.S.C. 154(b) by 229 days.

(21) Appl. No.: 15/909,973

(22) Filed: Mar. 1, 2018

(65) Prior Publication Data

US 2019/0271505 A1 Sep. 5, 2019

(51) Int. Cl.

| | |
|---|---|
| ***F26B 5/04*** | (2006.01) |
| ***B27K 3/02*** | (2006.01) |
| ***F26B 3/347*** | (2006.01) |
| ***B27K 5/00*** | (2006.01) |
| ***F26B 19/00*** | (2006.01) |

(52) U.S. Cl.

CPC ..... *F26B 5/048* (2013.01); *B27K 3/0214* (2013.01); *B27K 5/003* (2013.01); *F26B 3/347* (2013.01); *F26B 19/005* (2013.01); *B27K 2240/10* (2013.01); *F26B 2210/16* (2013.01)

(58) Field of Classification Search

CPC ..... F26B 5/048; F26B 3/347; F26B 19/005; F26B 2210/16; F26B 13/008; F26B 15/18; F26B 2210/14; B27K 3/0214; B27K 5/003; B27K 2240/10

USPC ..... 34/259

See application file for complete search history.

(56) References Cited

U.S. PATENT DOCUMENTS

| | | | | |
|---|---|---|---|---|
| 3,474,208 | A * | 10/1969 | Herbert | H05B 6/78 219/692 |
| 3,721,013 | A | 3/1973 | Miller | |
| 3,749,874 | A * | 7/1973 | Edgar | H05B 6/76 219/699 |
| 3,775,860 | A * | 12/1973 | Barnes | F26B 3/34 34/264 |

(Continued)

FOREIGN PATENT DOCUMENTS

| | | | | |
|---|---|---|---|---|
| CN | 103115481 | A * | 5/2013 | |
| EP | 0578595 | A1 * | 1/1994 | A01M 1/226 |

OTHER PUBLICATIONS

Request for DIY Portable Microwave Accesible at: https://www.instructables.com/community/Request-DIY-Portable-Microwave/ (Year: 2013).*

*Primary Examiner* — Justin M Jonaitis

(57) ABSTRACT

A portable electromagnetic wave drying apparatus is provided for the in-situ reduction of moisture in structural members within a wood frame construction. The apparatus comprises at least one electromagnetic wave generation assembly and an electromagnetic wave applicator. Also provided is an electromagnetic wave treatment method for the in-situ reduction of moisture content in a structural member within a wood frame construction. The method comprises contacting a portion of the structural member with electromagnetic waves for a period of not more than 30 minutes and then allowing the structural member to rest for a period of not more than 90 minutes. The apparatus and method are useful in the remediation of wood frame structures that have been exposed to flood waters.

20 Claims, 3 Drawing Sheets

(56) References Cited

U.S. PATENT DOCUMENTS

| | | | | | |
|---|---|---|---|---|---|
| 4,370,534 | A * | 1/1983 | Brandon | A01M 1/226 | 219/695 |
| 5,278,375 | A * | 1/1994 | Berteaud | H05B 6/78 | 219/693 |
| 5,635,143 | A | 6/1997 | White | | |
| 5,968,401 | A * | 10/1999 | Roy | A01M 1/226 | 219/679 |
| 6,105,278 | A * | 8/2000 | Gerrish | F26B 25/225 | 34/497 |
| 9,504,098 | B2 * | 11/2016 | Peelamedu | H05B 6/6482 | |

* cited by examiner

PORTABLE ELECTROMAGNETIC WAVE DRYING APPARATUS AND METHOD FOR IN-SITU DRYING OF STRUCTURAL MEMBERS IN WOOD-FRAME CONSTRUCTION

FIELD OF THE INVENTION

The invention pertains to a method for the In-situ drying of members within a wood-frame construction and a portable, electromagnetic-wave drying apparatus useful in performing the method. The inventive method and apparatus are particularly useful in the remediation of wood-frame structures that have been exposed to floodwaters.

BACKGROUND OF THE INVENTION

Wood-frame construction is a common and economical building technique for residential and commercial buildings. Spruce, Pine, or Fir ("SPF") dimensional lumber, such as common 2×4's and 2×6's, are the primary structural members within wood-frame constructions. Most commonly, these structural members are placed in a standard arrangement, starting with a horizontal "bottom plate" that is typically fastened with bolts or nails to a planar floor surface, typically comprising concrete or wood. Onto this bottom plate are fastened multiple, parallel, vertical "studs". These studs are typically placed at a predetermined spacing along the bottom plate of between 406 mm and 610 mm (16 inches and 24 inches) and are fastened at the top to one or more horizontal "headers". This combination of interconnected horizontal and vertical structural members forms an immobile, rigid rectangular framing assembly known as a "stud-wall". One or more wall coverings, such as siding, wall board, or laminated-wood sheets (e.g., plywood or Oriented Strand Board/OSB) are then affixed to the stud-wall to form vertical wall surfaces that may both define the building envelope and also divide the interior of the structure into individual rooms. A key feature of the stud-wall design in wood-frame constructions is that it incorporates a hollow wall cavity between the wall covering surfaces; the wall cavity is most commonly between about 100 mm to 150 mm in depth (4 to 6 inches), which provides sufficient internal space to contain other building elements such as electrical wiring, plumbing, climate control ductwork, and insulating materials, such as glass-fiber insulation batts.

In a flood event, wood-frame constructions may be adversely impacted by rising water. In particular, the structural members within wood-frame constructions, as well as the associated wall covering materials and any building elements within the wall cavities, may absorb excessive amounts of moisture. The exact quantity of water absorbed will of course depend on various factors, such as the portion of structural member surface-area that is exposed to moisture and the duration of the water contact. Within the Forest Products industry, the "Moisture Content" of wood is defined as the ratio of the mass of water within a given sample to the mass of the dry wood in that sample, and this measurement is reported as the percent moisture content (% MC). It is common for wooden structural members to reach 30% moisture content or greater even with only brief floodwater exposures.

Once wetted, it is essential that the structural members return to normal levels of moisture in order to prevent the growth of mold and fungus. Fungal growth is a significant threat to structural integrity of wood-frame constructions because fungi will actually consume wood, and if left unaddressed, will eventually compromise the building. Though mold does not directly impact structural integrity, mold growth is a known health hazard to building occupants.

In their publication, "Air Drying of Lumber", FPL-GTR-117 (page 4), the U.S. Department of Agriculture teaches that Fungi cannot grow in wood with a moisture content of 20% or less. Additionally, the publication "A Brief Guide to Mold, Moisture, and Your Home", EPA 402-K-02-003, from the U.S. Environmental Protection Agency, teaches maintaining wooden structural members at not more than 15% Moisture Content to avoid mold growth. Thus, it is understood that structural members must be returned to not more than 15% MC in order to eliminate the possibility of both mold and fungal growth within wood-frame constructions.

In the publication, "Initial Restoration for Flooded Buildings," (FEMA 549, Appendix E, pp 9-12), the U.S. Federal Emergency Management Agency teaches the following steps to remediate stud-walls within a wood-frame construction after a flood event:

1. remove at least the lower portion of the wall coverings from the stud-wall surface,
2. extract any damaged building elements and/or wet insulation from within the wall cavity, and
3. allow the structural members within the stud-wall to dry.

If these teachings are followed, one can typically expect excess moisture to evaporate from the structural members of flooded stud walls over a period of three-to-five weeks, although it may take longer if higher moisture content has been reached. It is of course apparent that the longer that wooden structural members remain above 15% moisture content, the greater the potential for biological growth to occur. Additionally, during the time that the walls are open and drying, refurbishment cannot proceed and the affected building is often unsuitable for use. It is therefore highly desirable to accelerate the process of drying these wet structural members. The electromagnetic wave (EMW) treatment method and apparatus of the present invention achieves such an improvement in drying speed.

U.S. Pat. No. 5,635,143 teaches a method and apparatus for the removal of contaminated concrete. It does not teach an EMW treatment method for the In-situ reduction of moisture content in a structural member within a wood-frame construction. The prior art apparatus comprises a microwave generator, a specially-inclined waveguide, and a vacuum system in order to demolish and extract material from the concrete surface to be cleaned. While there is some similarity to the inventive apparatus, it is clear that the requirement for an angled waveguide and vacuum system—elements not required in the drying apparatus of the present invention—is fundamental to the intended purpose of this prior art apparatus.

U.S. Pat. No. 3,721,013 teaches an improved Kiln-drying method for batches of green lumber, using a combination of radio-frequency energy, heated air circulation and humidity control. It does not teach an EMW treatment method for the In-situ reduction of moisture content in a structural member within a wood-frame construction. Instead, the subject Kiln method teaches the use of a large, stationary chamber into which are placed the pieces that are to be dried. Neither large-scale objects that exceed the dimensions of this chamber nor immobile objects can be treated in such an apparatus. Additionally, the prior-art treatment method is a lengthy process taking many days to complete and requiring the monitoring and adjustment of both temperature and humidity according to a specified "drying schedule". By contrast, the portable EMW drying apparatus of the present invention is a small-scale device capable of easy movement from one geographic location to another. By intention, it is easily transported to the location of a previously flooded wood-frame structure and is capable of drying one or more of the constituent structural members in-situ. It will be immediately obvious that there are tremendous time and cost savings in not having to disassemble a wood-frame construction in order to dry its component structural members. Furthermore, the EMW treatment method of the present invention is far less complex in its implementation, given that there is no need to mimic the drying schedule of a lumber mill kiln.

Given the limited teachings in the art of post-flood remediation, it is clear that there is a need for a simple and expedient method of drying wood-frame structures. In particular, the general public would greatly benefit from an improved method for the In-situ reduction of moisture content in a structural member within a wood-frame construction. The Apparatus and Method of the present invention serve to address this unmet need.

BRIEF SUMMARY OF THE INVENTION

One aspect of the invention provides an EMW treatment method for the In-situ reduction of moisture content in a structural member within a wood-frame construction comprising the following sequence of steps:

a. Providing a structural member within a wood-frame construction
b. Providing a source of electromagnetic waves
c. Directing said electromagnetic waves to contact at least a portion of said structural member for a drying period of not more than 30 minutes
d. Allowing said structural member to rest for a resting period of not more than 90 minutes and
e. Optionally, determining the post-resting period moisture content of said structural member.

In at least one embodiment, said electromagnetic waves are provided at a frequency of from 100 MHz to 3000 MHz. In at least another embodiment, said electromagnetic waves are provided at a frequency selected from the list including: 433.9 MHz, 915 MHz, 2.45 GHz, 5.8 GHz, and 24.1 GHz.

In at least one embodiment, the steps of the method are repeated until the post-resting moisture content of said structural member is less than or equal to a maximum desired moisture content.

In at least one further embodiment, the maximum desired moisture content is not more than 19%, preferably not more than 15%

Another aspect of the invention relates to a portable EMW drying apparatus for the In-situ reduction of moisture content in structural members within a wood-frame construction, said portable drying apparatus comprising at least one electromagnetic wave generation assembly and an electromagnetic wave applicator.

In at least one embodiment of the invention, said portable EMW drying apparatus has a total mass of less than about 45 kg (100 lbs), preferably less than about 23 kg (50 lbs), most preferably less than about 10 kg (25 lbs). In at least one other embodiment, said portable EMW drying apparatus comprises one or more of handles, wheels, roller-bearings, supporting legs, and runners.

In at least one additional embodiment, said electromagnetic wave applicator has a 3-D geometry selected from cuboid, cylinder, pyramid, cone, triangular prism, arched prism, or hemisphere. In a preferred embodiment, said electromagnetic wave applicator has a 3-D geometry selected from cuboid, pyramid, triangular prism, or arched prism. In at least one embodiment, said electromagnetic wave applicator has a cross-section along the Y:Z plane selected from rectangle, triangle, parabola, or trapezoid.

In at least one more embodiment, said electromagnetic wave applicator is fitted with one or more rectangular contact apertures. In at least one further embodiment, said rectangular contact apertures are adjustable. In at least one more embodiment, said electromagnetic wave applicator comprises a mode stirrer.

In at least one other embodiment, said at least one electromagnetic wave generation assembly produces electromagnetic waves at a frequency of from 100 MHz to 30 GHz. In at least one additional embodiment, said electromagnetic wave generation assembly comprises one or more of a transformer, a capacitor, a thermostat, a cooling fan, a control board, and a timing circuit. In at least one further embodiment, said at least one electromagnetic wave generation assembly comprises at least one Magnetron, and in some additional embodiments may optionally comprise at least one moisture-resistant cover placed between the at least one Magnetron and the body of the electromagnetic wave applicator.

In at least one embodiment, the portable EMW drying apparatus may further comprise a waveguide. In at least one further embodiment, said waveguide has a rectangular cross section.

In at least one more embodiment, the portable EMW drying apparatus further comprises one or more ventilation openings, sized to prevent electromagnetic wave propagation there through.

DETAILED DESCRIPTION

Figure 1A:
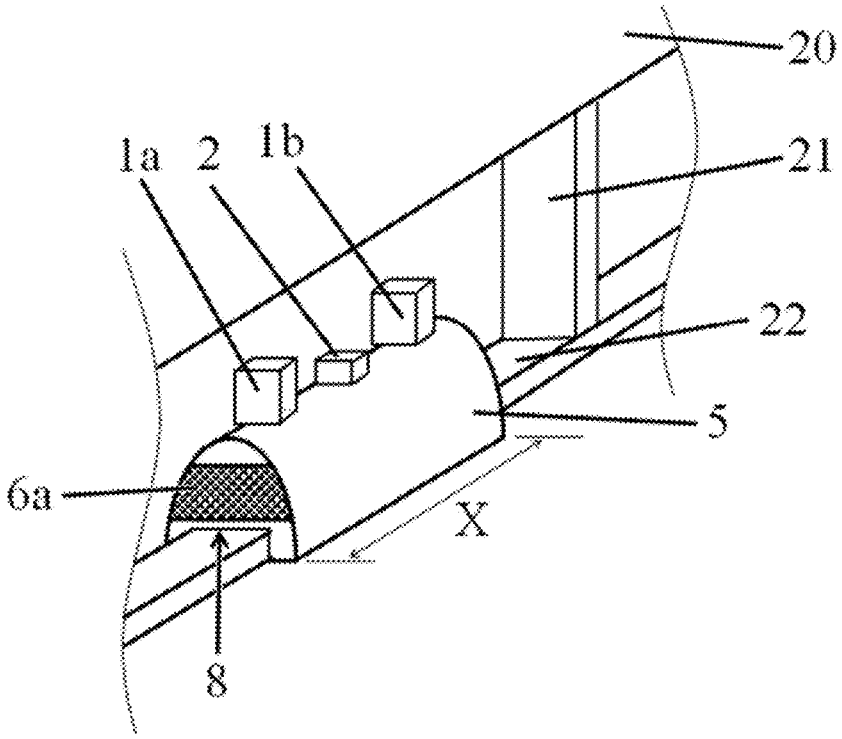
FIG. 1A is an isometric view of a first embodiment of a portable EMW drying apparatus, representing the apparatus' placement within a wall cavity

It is to be understood that both the foregoing general description and the following detailed description are exemplary and explanatory only and are not restrictive of the present teachings. All patents and patent applications cited in this application are expressly incorporated by reference in their entirety for any purpose. When definitions of terms in incorporated references appear to differ from the definitions provided in the present teachings, the definition provided in the present teachings shall control. It will be appreciated that there is an implied "about" prior to the temperatures, dimensions, flow rates, concentrations, times, etc. discussed in the present teachings, such that slight and insubstantial deviations are within the scope of the present teachings.

Unless otherwise defined, scientific and technical terms used in connection with the present teachings described herein shall have the meanings that are commonly understood by those of ordinary skill in the art. Further, unless otherwise required by context, singular terms shall include pluralities and plural terms shall include the singular. Generally, nomenclatures utilized in connection with, and techniques of, electromagnetic wave generation and transmission are those well known and commonly used in the art. As utilized in accordance with the embodiments provided herein, the following terms, unless otherwise indicated, shall be understood to have the following meanings:

As used herein, the term "EMW" means "Electromagnetic Wave"

The term "microwave" refers to electromagnetic waves with a frequency of from 100 MHZ to 3000 MHz.

The term "Delivered Power" refers to the power of the EMW produced by a given EMW generation assembly; this is contrasted with "Supplied Power", which is the power consumed by an EMW generation assembly, including any efficiency losses.

As used herein, the use of general directions along the X, Y, and Z axes are understood to conform to a standard orthogonal coordinate system. Unless otherwise specified, the Z dimension is presumed to be oriented vertically, while the X and Y dimensions are intended to be oriented within the horizontal plane. Further, named planes—such as the X:Y plane, the X:Z plane and the Y:Z plane—are understood to have their conventional meanings for the purposes of orienting surfaces and cross-sections within three-dimensional space. Finally, it should be understood that, as used herein, dimensional measurements associated with the variables X, X2, X3, Y, Y2, Y3, Z, Z2, and Z3 are intended to imply both a length and a direction within said orthogonal coordinate system.

The term "3-D geometry" refers to the shape of three-dimensional objects, and the names of three-dimensional shapes are intended to have their commonly understood meanings.

The term "Moisture Content" as used herein refers to the moisture content of wood. "Percent Moisture Content" or "% MC" is understood to match the term of art from the Forest Products Industry and is defined as the ratio of the mass of water to the mass of dry wood in a given sample, and represented by the formula:

$$\% \text{ MC} = 100 \times (\text{Mass of Water in Wood})/(\text{Mass of Oven-dry Wood}) \quad \text{[Eqn 1]}$$

The Forest Products Industry uses the "oven drying" method as described in ASTM D4442-16 to measure % MC. Using this method, a wood sample is completely dried in an oven and the masses before and after drying are compared to determine how much water was removed, thereby providing the data needed to calculate % MC from the above formula (Equation 1). As a point of reference, it is noted that a typical piece of commercially-available SPF dimensional lumber, generally referred to as "KD19" lumber, has been kiln-dried to an average moisture content of about 19%.

One embodiment of the invention provides a portable EMW drying apparatus for the In-situ reduction of moisture content in structural members within a wood-frame construction, said portable drying apparatus comprising at least one electromagnetic wave generation assembly and an electromagnetic wave applicator.

As used herein, the term "portable" refers to an apparatus capable of easy movement from one geographic location to another. As previously described, the portable EMW drying apparatus of the present invention is intended to be transported to the location of one or more stationary objects requiring treatment. In a preferred embodiment, the portable apparatus of the present invention is easily transported and positioned for use by one person. As a practical matter, this means that the apparatus must be limited in its overall dimensions so as to be easily conveyed through passageways and openings within buildings, such as for example, the interior halls and doorways of a residential structure. It is therefore preferable that at least one dimension of the portable apparatus of the present invention should be not greater than about 914 mm (36 inches). Another practical consideration facilitating portability is a limitation on the total mass of the apparatus. In one embodiment, the portable EMW drying apparatus of the present invention has a total mass of less than about 45 kg (100 lbs), preferably less than about 23 kg (50 lbs), most preferably less than about 10 kg (25 lbs). In some embodiments, the portable EMW drying apparatus may comprise one or more of handles, wheels, roller-bearings, supporting legs, and runners in order to facilitate movement and positioning of the apparatus.

In at least one embodiment, the electromagnetic wave applicator has a 3-D geometry selected from cuboid, cylinder, pyramid, cone, triangular prism, arched prism, or hemisphere. In a preferred embodiment, said electromagnetic wave applicator has a 3-D geometry selected from cuboid, pyramid, triangular prism, or arched prism.

Figure 1B:
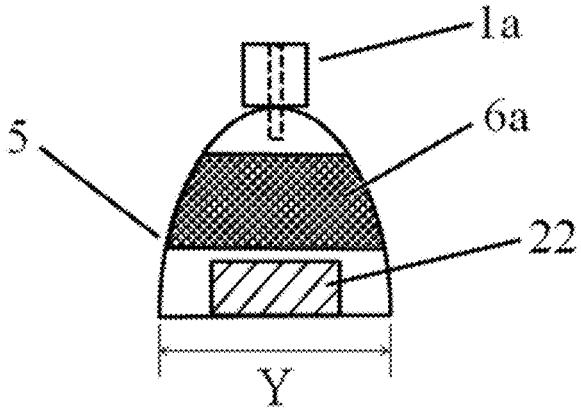
FIG. 1B is a side view of a first embodiment of a portable EMW drying apparatus

FIGS. 1A and 1B depict two different views of a first embodiment of the apparatus of the present invention. In FIG. 1A, the apparatus is shown in an isometric view as it would appear in use within the wall cavity of a typical wood-frame stud wall. The stud wall is comprised of a horizontally-oriented 2×4 bottom plate 22, to which is anchored (with nails) multiple vertical 2×4 studs 21 (only one shown for clarity). It should be noted that bottom plate 22 is shown in an isometric view in FIG. 1A and a cross-sectional view in FIG. 1B. A gypsum-based drywall sheet 20 is affixed to the stud wall. It should also be noted that this figure represents the wall in the "open" state, in which the lower portion of the wall covering has been removed in order to dry the structural members. In this illustration, the apparatus is specifically positioned for the in-situ drying of bottom plate 22. FIG. 1B shows a side view of the same apparatus under the same conditions of use.

FIG. 1B illustrates the parabolic cross section along the "Y:Z" plane of the electromagnetic wave applicator 5 and FIG. 1A illustrates the generally arched surface of applicator 5, with its two flat, generally parabolic panels on the sides. The combination of these three component pieces forms an enclosed volume which serves to both direct the EMW energy toward the target (in this case, bottom plate 22) as well as shield the user from any stray EMW emissions. From a shape perspective, this electromagnetic wave applicator is said to have a 3-D geometry known as an "arched prism". The "interfacial perimeter" of electromagnetic wave applicator 5 is formed by the edges closest to the interface between applicator 5 and bottom plate 22—In this orientation of the apparatus, the interfacial perimeter is shown to comprise the bottom-most edges of the apparatus. The interfacial perimeter is generally rectangular, and has an axial length X of about 406 mm (16 inches) and a width Y of about 152 mm (6 inches). It is preferred that the electromagnetic wave applicator be constructed from at least one conductive metal, such as copper, brass, steel, or aluminum. Optionally, wave applicator 5 may further comprise a high-conductivity interior surface coating, such as for example a thin layer of gold. In one embodiment, it is preferred that the axial length, X, of applicator 5 be not more than 914 mm (36 inches), more preferred that it be not more than 610 mm (24 inches), most preferred that it be not more than 406 mm (16 inches).

Also generally shown in these figures is the electromagnetic wave generation assembly, comprising two magnetrons, 1*a* and 1*b*, as well as transformer 2, which are mounted directly on applicator 5. In at least one additional embodiment, said electromagnetic wave generation assembly may comprise one or more of a transformer, a capacitor, a thermostat, a cooling fan, a control board, and a timing circuit (not shown). Additionally, due the high-voltages utilized, it is strongly recommended that the electromagnetic wave generation assembly further comprise a protective enclosure (not shown) to prevent accidental contact with the components of the assembly. In the embodiment of FIGS. 1A and 1B, both Magnetrons 1*a* and *b* produce electromagnetic waves at a frequency of 2.45 GHz and each has a delivered power of 1000 Watts, yielding a total delivered power of 2000 Watts for the apparatus.

Additionally, in this embodiment, the side of the apparatus is shown to further comprise at least one perforated plate 6*a*. The perforated plate comprises a plurality of 1 mm diameter holes that provide ventilation for the interior of the electromagnetic wave applicator while being of sufficiently small diameter as to prevent electromagnetic wave propagation there through. Lastly, this embodiment comprises rectangular contact aperture 8, which is cut into the sides of the apparatus at the interfacial perimeter and is sized to match the cross-sectional dimensions of bottom plate 22. In some embodiments of the inventive apparatus, rectangular contact aperture 8 is formed from one or more sliding plates to provide means of adjustment to the dimensions of the aperture.

In an alternative embodiment (not shown), electromagnetic wave applicator 5 has a cross-section along the Y:Z plane that is a triangle, rather than a parabola, and a 3-D geometry that is a triangular prism.

In yet another embodiment (not shown), electromagnetic wave applicator 5 has a cross-section along the Y:Z plane that is a rectangle, rather than a parabola, and a 3-D geometry that is a cuboid (also known as a rectangular prism).

Figure 2A:
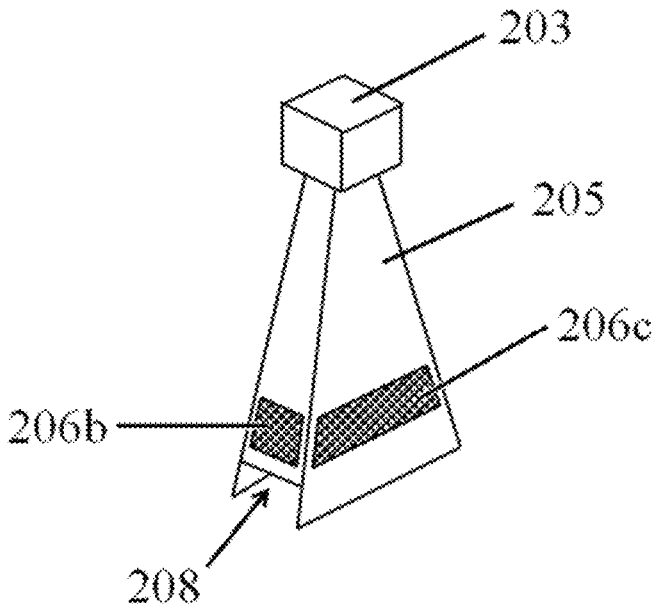
FIG. 2A is an isometric view of a second embodiment of a portable EMW drying apparatus, oriented for treating a horizontal structural member
Figure 2B:
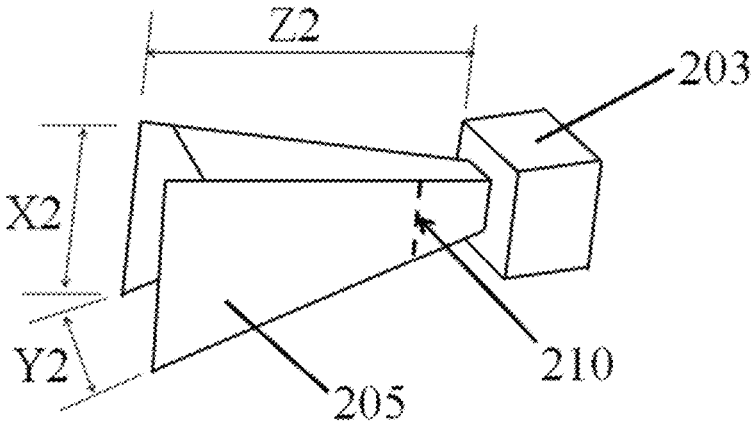
FIG. 2B is an isometric view of a second embodiment of a portable EMW drying apparatus, oriented for treating a vertical structural member

FIGS. 2A and 2B depict two different views of a second embodiment of the inventive portable EMW drying apparatus. In FIG. 2A, the apparatus is shown in an isometric view, oriented for treating a horizontal structural member, while in FIG. 2B, the same apparatus is shown in a different isometric view, oriented for treating a vertical structural member.

FIGS. 2A and 2B illustrate that the electromagnetic wave applicator 205, which comprises four trapezoidal panels, has a 3-D geometry of a pyramid. The combination of these four surfaces forms an enclosed volume with a rectangular cross section along the X2:Y2 plane and a generally triangular cross section along the X2:Z2 plane; the enclosed volume serves to both direct the EMW energy toward the structural member to be treated (not shown) as well as to shield the user from any stray EMW emissions. The interfacial perimeter of the electromagnetic wave applicator 205 is formed by the edges closest to the interface between applicator 205 and its treatment-target. In the orientation of FIG. 2A, the interfacial perimeter is shown as the bottom-most edges of the apparatus and rectangular contact aperture 208 is not adjustable. It is preferred that electromagnetic wave applicator 205 be constructed from at least one conductive metal, such as copper, brass, steel, or aluminum. Optionally, wave applicator 205 may further comprise a high-conductivity interior surface coating, such as for example a thin layer of gold. Also shown in FIG. 2A are at least two perforated metal screens 206*b* and 206*c* (not shown in FIG. 2B for clarity), each comprising a plurality of 2 mm diameter holes that provide ventilation for the interior of electromagnetic wave applicator 205 while being of sufficiently small diameter as to prevent electromagnetic wave propagation there through In at least one embodiment of the inventive portable EMW drying apparatus, an electromagnetic wave applicator of generally pyramidal shape further comprises dimensions that comply with at least one of Electronics Industry Association (EIA) standards WR340 or WR430.

In the alternative orientation of FIG. 2B, the interfacial perimeter is shown as the left-most edges of the apparatus. In the embodiment of FIG. 2B, the apparatus can be seen to have an axial length X2 of about 130 mm (5 inches), a width Y2 of about 100 mm (4 inches), and a Z2 dimension of about 225 mm (9 inches).

In the embodiment of FIGS. 2A and 2B, electromagnetic wave generation assembly 203 comprises one magnetron that produces microwaves and has an output power of 1000 Watts. In at least one other embodiment, said at least one electromagnetic wave generation assembly produces electromagnetic waves at a frequency of from 100 MHz to 30 GHz. In another embodiment, EMW generation assembly 203 further comprises a timing circuit which can be used to control the duration of the magnetron's operating period.

Additionally, in this embodiment, the interior of electromagnetic wave applicator 205 further comprises at least one moisture-resistant cover 210 between the Magnetron and the body of electromagnetic wave applicator 205. The material of construction for cover 210 may comprise one or more of mica, glass, polyethylene (PE), and polypropylene (PP). The cover should not comprise polymethylmethacrylate (PMMA) nor polystyrene (PS) due to the tendency for these two plastics to breakdown when exposed to electromagnetic waves.

In a further embodiment of the apparatus represented in FIG. 2B, in which wave applicator 205 is placed against one face of a vertical structural member, an optional metal plate is additionally placed against the opposing face of said vertical structural member, parallel to the X2:Y2 plane, and optionally fixed in place with temporary clamps or fasteners, to minimize electromagnetic wave transmission through or around said vertical structural member.

In an alternative embodiment (not shown), electromagnetic wave applicator 205 has a circular cross section along the X2:Y2 plane, rather than a rectangle, and a 3-D geometry that is a cone.

Figure 3:
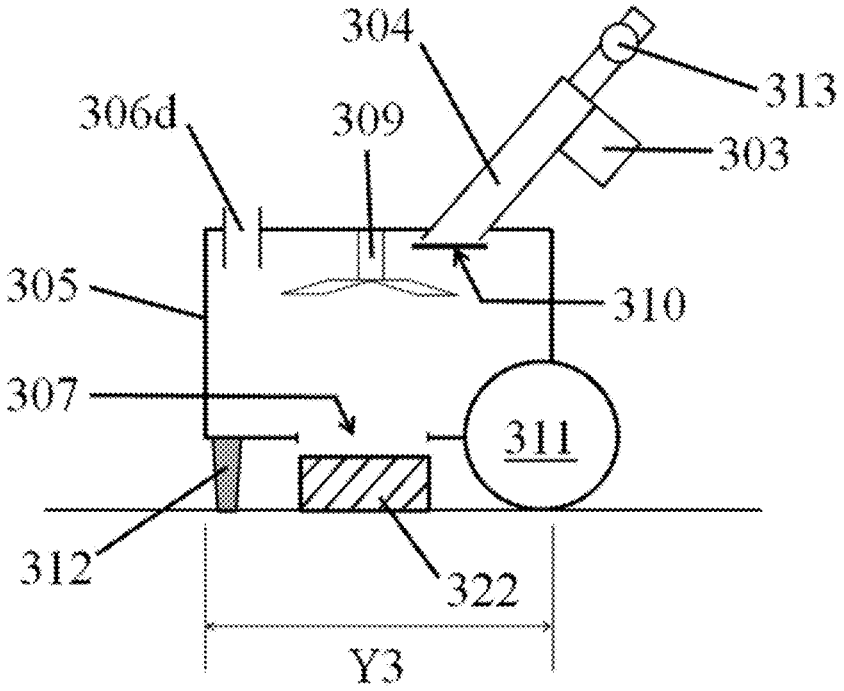
FIG. 3 is a side view of a third embodiment of a portable EMW drying apparatus

FIG. 3 depicts a side view of a third embodiment of the inventive portable EMW drying apparatus. The figure illustrates that the electromagnetic wave applicator 305, which comprises six rectangular surfaces, has a 3-D geometry of a cuboid. The combination of these six surfaces forms an enclosed volume with a rectangular cross section along both the X3:Y3 plane and the Y3:Z3 plane; the enclosed volume serves to both direct the EMW energy toward structural member 322 (shown in cross section) as well as to shield the user from any stray EMW emissions. It is preferred that electromagnetic wave applicator 305 be constructed from at least one conductive metal, such as copper, brass, steel, or aluminum. Optionally, wave applicator 305 may further comprise a high-conductivity interior surface coating, such as for example a thin layer of gold. In this embodiment, the "interfacial perimeter" of the electromagnetic wave applicator is formed by the edges of rectangular contact aperture 307. From the figure, it is clear that the apparatus rests in a position above the target, with support legs 312 and wheels 311 providing stabilization of the apparatus. It is preferred that the bottom of the apparatus proximate to aperture 307 makes direct contact with the upper surface of structural member 322 in order to minimize stray electromagnetic wave propagation to the environment.

Optional vent pipe 306*d*, with an internal diameter of between 6 mm and 25 mm (0.25 inch and 1 inch), provides ventilation for the interior of electromagnetic wave applicator 305 while being of sufficiently small diameter as to minimize electromagnetic wave propagation there through.

FIG. 3 also illustrates optional mode stirrer 309, comprising from 2 to 6 angled metal fan blades; through their rotation about the vertical axis, the blades of stirrer 309 can be used to randomly distribute electromagnetic waves throughout the enclosed volume of electromagnetic wave applicator 305.

The apparatus in FIG. 3 has an axial length X3 (directed into the page, not shown) of about 305 mm (12 inches) and a width Y3 of not more than about 1000 mm (39 inches). The vertical height (Z3, not shown) is not particularly critical and may for example range from about 76 mm (3 inches) to about 305 mm (12 inches). Through the combined use of handles 313 and wheels 311, the portability of the apparatus of this embodiment is enhanced and the apparatus can be easily moved when required.

In this embodiment, electromagnetic wave generation assembly 303 comprises one magnetron that produces electromagnetic waves at a frequency of 915 MHz and has an output power of 500 Watts. EMW generation assembly 303 further comprises a control board which actuates stirrer 309 when the magnetron is operating. The electromagnetic waves produced by the magnetron propagate through wave guide 304, which has a rectangular cross section, and are delivered to electromagnetic wave applicator 305. It is preferred that wave guide 304 be constructed from at least one conductive metal, such as copper, brass, steel, or aluminum. Optionally, wave guide 304 may further comprise a high-conductivity interior surface coating, such as for example a thin layer of gold.

In this embodiment, the interior of electromagnetic wave applicator 305 further comprises at least one moisture-resistant cover 310 between the Magnetron and the body of electromagnetic wave applicator 305.

In an alternative embodiment (not shown), electromagnetic wave applicator 305 has a circular cross section along the X3:Y3 plane, rather than a rectangle, and a 3-D geometry that is a cylinder.

In yet another embodiment (not shown), electromagnetic wave applicator 305 has a trapezoidal cross section along the Y3:Z3 plane, rather than a rectangle, and a 3-D geometry known as a "trapezoidal prism".

In a first alternative embodiment of the inventive portable EMW drying apparatus, the previously described apparatus of FIG. 3 comprises a larger wave applicator 305, wherein the axial length X3 is about 610 mm (24 inches).

In a second alternative embodiment of the inventive portable EMW drying apparatus, the previously described apparatus of FIG. 3 comprises a still larger wave applicator 305, wherein the axial length X3 is about 1000 mm (39 inches).

In a third alternative embodiment of the inventive portable EMW drying apparatus, the previously described apparatus of FIG. 1A comprises a larger wave applicator 5, wherein the axial length X is about 1220 mm (48 inches) and the width Y is about 127 mm (5 inches). In this third alternative embodiment, there are five identical magnetrons (as compared to the two depicted in FIG. 1A), each with a delivered power of 2,000 Watts. The magnetrons are distributed evenly along the axial length of the wave applicator to provide uniform EMW coverage; for example, using 0 mm (0 inches) as a starting point, these five magnetrons may be placed at the following distances along the X axis: 102 mm (4 inches), 356 mm (14 inches), 610 mm (24 inches), 864 mm (34 inches) and 1118 mm (44 inches). Such an alternative embodiment is especially useful in drying wet vertically-oriented studs with high moisture content, for example moisture content in excess of 30%.

It is known that the distribution of moisture in wood samples is typically not homogenous, with the wood core most often being at higher moisture content than the surface. The surfaces of the wood which are in contact with the air allow moisture to escape by evaporation. Surface evaporation is a fairly rapid process that is primarily dependent on the relative humidity in the environment, and the temperature of the wood sample. The exposed surface area of the wood can also be a significant factor affecting the evaporation rate. In contrast, drying of the wood core is controlled by the concentration gradient between the core and the surface. The diffusion of moisture from the core toward the surface happens very slowly relative to surface evaporation. As a result, it is possible for direct measurements of the surface to indicate relatively dry wood, when in fact the average moisture content of the sample is significantly higher.

Although slightly less precise than the previously-described oven-drying method, % MC may be determined quickly and easily using a Pin-type moisture meter—an electronic device which functions similar to an ohm meter. A moisture meter measures the conductivity between two pins on its case that are placed in contact with the wood sample and—after compensating for wood type and temperature—converts this conductivity to a direct measurement of % MC. Inexpensive models of this type of device are capable of measurements that are accurate to within 2% for moisture content of up to 60%. Suitable pin-type moisture meters for use with the method of the present invention are commercially available from Extech Instruments of Nashua, N.H., USA and Amphenol Thermometrics Inc. of St. Mary's, Pennsylvania, USA. It should be noted, however, that because the meter is based on conductivity, the highest conductivity point that the pins come into contact with will register as the measured moisture level. This means that it is difficult to know the true moisture content of a wood sample if the pins of the meter only contact the wood surface. To address this, it is preferred to drive two screws from the surface of the sample to the mid-point (core) of the sample, and then obtain the conductivity measurement by placing the pins in contact with these screws. In this way, one can determine the highest moisture content within the cross-section of the wood sample. Given the non-homogeneous nature of wood, this ultimately means that a moisture measurement, taken via screws through the sample, will always be equal to or slightly greater than the average % MC value for the wood sample.

One embodiment of the invention provides an EMW treatment method for the In-situ reduction of moisture content in a structural member within a wood-frame construction comprising the following sequence of steps:

a. Providing a structural member within a wood-frame construction
b. Providing a source of electromagnetic waves
c. Directing said electromagnetic waves to contact at least a portion of said structural member for a drying period of not more than 30 minutes d. Allowing said structural member to rest for a resting period of not more than 90 minutes Specific drying periods and resting periods for use with the inventive treatment method can be determined based upon the inter-relationship of the delivered EMW power "P", in Watts, and the axial length of the structural member to be treated "X", in millimeters. In this way, the inventive treatment method may be applied in combination with a plurality of portable EMW drying apparatus.

In accordance with this method, the drying period "D", in minutes, is defined by the relationship:

$$D=13.1234(X)/(P) \quad \text{[Eqn 2]}$$

And the resting period "R", in minutes, is defined by the relationship:

$$R=0.0656(X) \quad \text{[Eqn 3]}$$

To further illustrate the use of Equations 2 and 3, Table 1 provides a summary of the values of D and R for several of the previously described embodiments of the inventive apparatus.

By way of clarification and not limitation, these Formulae are known through inventor's investigations to be valid for values of X from 0 to 1220 mm (from 0 to 48 inches) and for values of P from 0 to 10,000 Watts. It is anticipated that these formulae (Equations 2 and 3) are valid for still greater values of X and P, but this has not yet been verified through performance testing. Given the benefit of the present disclosure, it should be within the ability of one of ordinary skill to make small adjustments to the drying period and/or the resting period and then quickly assess the acceptability of the treatment method without deviating from the spirit of the present invention.

TABLE 1

| | X | | P | D | R |
|---|---|---|---|---|---|
| Embodiment | mm | inches | Watts | mins | mins |
| First (FIGS. 1A and B) | 406 | 16 | 2000 | 2.7 | 26.6 |
| Second (FIGS. 2A and B) | 130 | 5 | 1000 | 1.7 | 8.5 |
| Third (FIG. 3) | 305 | 12 | 500 | 8.0 | 20.0 |
| First Alternative | 610 | 24 | 500 | 16.0 | 40.0 |
| Second Alternative | 1000 | 39 | 500 | 26.2 | 65.6 |
| Third Alternative | 1220 | 48 | 10000 | 1.6 | 80.0 |

Table 2 summarizes drying experiments performed in accordance with the inventive treatment method. Six-inch long (150 mm) samples of KD19 Douglas Fir 2×4 dimensional lumber were soaked in potable water for 24 hours until they obtained an average moisture content of about 25%. An Extech model M0230 pin moisture meter was used to determine % MC of the wood surface and core (using the above-described 'screw' measurement methodology). The 2×4 samples were treated in a Sanyo model # EM-P540W microwave oven over three consecutive cycles as described in Table 2. The microwave oven had a supplied power of 1480 watts and produced electromagnetic waves at 2.45 GHz with a delivered power of 1000 Watts. After each treatment/rest cycle, the internal wood temperature, the mass of the sample, and the % MC were measured. As can be seen from the results reported in Table 2, the inventive treatment method removed about 50 grams (1.76 ounces) of water in 35 total minutes, resulting in a final moisture content of well-below the 15% remediation requirement.

After testing, the samples reported in Table 2 were carefully inspected. No signs of physical damage (e.g., splitting, cupping, warping, or twisting) were found. Sample 1 was then cut in half along its long axis and inspected for internal signs of deterioration, discoloration, and thermal damage/burning—Again, there were no signs of damage found. These inspections verify that the method of the present invention can successfully reduce moisture content in wood structural members without causing damage to said members.

TABLE 2

| | | 1 | 2 |
|---|---|---|---|
| Initial Measurement | internal wood temperature before treatment (C.) | 19.4 | 19.0 |
| | Core Moisture Content (% MC) | 26.2 | 25.4 |
| | Top Surface Moisture Content (% MC) | 22.2 | 21.7 |
| | Average Moisture Content (% MC) | 24.9 | 24.2 |
| | Initial Mass of sample = water + wood (grams) | 297 | 273 |
| | Mass of Dry Wood in Sample (grams) | 238 | 220 |
| | Initial Mass of Water in Sample (grams) | 59.1 | 53.1 |
| | 2 minutes EMW treatment/10 minutes resting | | |
| Cycle 1 | internal wood temperature after treatment (C.) | 108.1 | 106.0 |
| | Mass of Sample at end of cycle (grams) | 280 | 256 |
| | Moisture Content at End of Cycle (% MC) | 17.7 | 16.4 |
| | 2 minutes EMW treatment/10 minutes resting | | |
| Cycle 2 | internal wood temperature after treatment (C.) | 151.3 | 146.2 |
| | Mass of Sample at end of cycle (grams) | 255 | 231 |
| | Moisture Content at End of Cycle (% MC) | 7.2 | 5.0 |
| | 1 minute EMW treatment/10 minutes resting | | |
| Cycle 3 | internal wood temperature after treatment (C.) | 139.7 | 138.6 |
| | Mass of Sample at end of cycle (grams) | 248 | 223 |
| | Moisture Content at End of Cycle (% MC) | 4.3 | 1.4 |
| Final Measurement | Top Surface Moisture Content (% MC) | 0 | 0 |
| | Total Water Removed (grams) | 49 | 50 |
| | Total Reduction in % MC | 20.6 | 22.8 |

Without being constrained by theory, it is postulated that the inventive EMW drying apparatus causes electromagnetic waves to penetrate approximately 1 inch below the surface of the wooden structural members, causing rapid, localized heating near the center of the material and subsequent "pressurization" of moisture at the core of the structural members being treated. This pressurization is believed to encourage accelerated transport of moisture to the surface, effectively increasing the rate of moisture diffusion through the wood. By directly addressing this rate-limiting step, the inventive EMW method is able to dry structural members in minutes as compared to the many weeks of time required for drying through unassisted evaporation. It is further hypothesized that the inventive EMW treatment method succeeds at quickly drying wooden structural members without physical damage (e.g., splitting, warping, or burning) because the method incorporates limitations on the rate of electromagnetic wave energy input into the structural member as well as requiring a resting period in which the internal "pressure" of moisture developed within the wood is allowed to dissipate.

Given the disclosure of the present method, one can easily envision extending the scope of use from the drying of individual structural members to the broader goal of drying entire wood-frame constructions. By way of example and not limitation, a homeowner employing the inventive method might initially place the EMW applicator of one embodiment of the inventive apparatus over a first segment of 2×4 bottom plate and, following the designated treat/rest cycle of the inventive method, dry a portion of the structural member. Once complete, the homeowner would then move the apparatus to an adjacent segment of the bottom plate and repeat the process again and again until the full length of the structural member is dried.

Because of the porous structure of wood, it should be noted that it is not strictly necessary to treat 100% of the length of an individual structural member, as moisture will tend to equilibrate via diffusion-like mechanisms across the length of the member. This means that the homeowner may omit treatment of segments comprising obstacles, such as for example piping, electric wiring, or the intersections between vertical and horizontal members within a stud wall, without fear of losing the benefits of the inventive method. Additionally, it is preferred to omit treatment of segments which may comprise elongated metal fasteners, such as for example bolts, nails, screws or staples, which might be prone to initiating electrical discharges when exposed to electromagnetic waves.

To achieve the minimum drying time for a wood-frame structure, one may further envision, given the benefit of the present disclosure, that the inventive method may be applied as a series of "overlapping" treatment cycles, in which the resting period for a first segment is utilized as the drying period for a second—and possibly a third and a fourth, or even up to a fifth segment—before returning to the first segment to complete another drying period. In this way, the time expended waiting for completion of the resting period in one segment of an individual structural member is beneficially used to reduce the overall duration of drying in the greater wood-frame construction.

Finally, it will be evident that one can further reduce the duration of drying by utilizing a plurality of portable EMW drying apparatus to concurrently dry multiple structural members within the same wood-frame construction.

Table 3 summarizes energy efficiency calculations for the tests of Table 2. It can be seen that about 67.5% of the electrical power supplied to the oven is converted to delivered power in the produced microwaves. Further, it can be seen that about 40-45% of the delivered microwave energy was used to evaporate water from the samples, while the remainder of the energy was lost to sensible heating of the wood and the environment. This means that the overall energy efficiency of converting supplied electrical energy into evaporation in accordance with the method of the present invention is slightly less than 30%.

TABLE 3

| | 1 | 2 |
|---|---|---|
| Total Water Removed (grams) | 49 | 50 |
| Internal Wood Temperature Before Treatment (C.) | 19.4 | 19.0 |
| Treatment Energy Required for Sensible Heating (kcal) | 4.0 | 4.1 |
| Treatment Energy Required for Vaporization (kcal) | 26.4 | 27.0 |
| Total Energy Required for Treatment (kcal) | 30.4 | 31.0 |
| Energy Supplied - Electric Input (kcal) | 106.1 | 106.1 |
| Energy Delivered - EMW Output (kcal) | 71.7 | 71.7 |
| Magnetron Efficiency = Energy Delivered/Energy Supplied (%) | 67.5 | 67.5 |
| Treatment Efficiency = Energy Required/Energy Delivered (%) | 42.4 | 43.3 |
| Overall Efficiency = Energy Required/Energy Supplied (%) | 28.7 | 29.2 |

Given the relatively low energy efficiencies indicated in Table 3, it might appear that the inventive method is economically unattractive and therefore of limited utility. As a general illustration of the energy cost to employ the inventive method, the following notional example is provided:

A single storey, residential wood-frame construction of about 142 square meters (1,500 square feet) has been exposed to 50 mm (two inches) of flood water for a period of 24 hours, resulting in a post-flood moisture content of 25% in the SPF 2×4 bottom plates within the stud walls. It is desired to remediate the structure such that the bottom plates are returned to a moisture content of 15% or less. The residence has an effective perimeter (=combined length of interior+exterior stud walls) of about 98.5 meters (320 linear feet) of bottom plate. According to the results of Table 1, four minutes (two cycles) of active microwave production is sufficient to achieve the desired target % MC within each 150 mm (six inch) segment of the bottom plate. This equates to (320 feet)×(4 minutes/0.5 feet)=2,560 minutes, or 42.7 hours, of equivalent magnetron operation to treat all of the affected structural members in the notional residence. Given that the magnetron requires 1480 watts of supplied power to operate, the total energy requirement to dry all of the bottom plate in the structure is 63.15 kilowatt-hours (kWh). At the time of this writing, the average cost of delivered residential power within the U.S. is about $0.10 per kWh. Therefore, the total energy cost to complete the drying of this notional residential wood-frame construction would be just $6.31. Additionally, it is apparent from this example that, with the simultaneous use of just two of the inventive portable EMW drying apparatus, this notional residential structure could be dried in less than 24 hours. Thus, it is evident that the inventive method and apparatus are both fast and economically attractive to use.

Taken as a whole, it is apparent that, due to the improvement in the speed of drying made possible by the inventive EMW drying apparatus and the associated EMW treatment method, it is entirely feasible to dry a significant portion of the in-situ structural members in a residence over the course of just a few hours and to remediate moisture absorption in an entire wood-frame construction in a far shorter time than has been previously possible.

What is claimed is:

1. An electromagnetic wave (EMW) treatment method to remediate stud-walls within a wood-frame construction after a flood event, comprising the following sequence of steps:

a) Providing a stud wall comprised of a horizontally-oriented 2×4 bottom plate to which is anchored multiple vertical 2×4 studs b) Providing a source of electromagnetic waves c) Directing said electromagnetic waves to contact at least a portion of said horizontally-oriented 2×4 bottom plate for a drying period of not more than 30 minutes d) Allowing said horizontally-oriented 2×4 bottom plate to rest for a resting period of not more than 90 minutes, and e) Determining a post-resting period moisture content of said horizontally-oriented 2×4 bottom plate wherein steps a) through e) of said EMW treatment method are repeated until the post-resting moisture content of said horizontally-oriented 2×4 bottom plate is not more than 19%.

2. The EMW treatment method of claim 1 wherein said electromagnetic waves are provided at a frequency of from 100 MHz to 3000 MHz.

3. The EMW treatment method of claim 1 wherein said electromagnetic waves have a delivered EMW power (P) of from 0 to 10,000 Watts.

4. The EMW treatment method of claim 3 wherein said at least a portion of said horizontally-oriented 2×4 bottom plate has an axial length (X) of from 0 to 1220 millimeters.

5. The EMW treatment method of claim 4 wherein the drying period (D), in minutes, is defined by the relationship: D=13.1234(X)/(P) and the resting period (R), in minutes, is defined by the relationship: R=0.0656(X).

6. The EMW treatment method of claim 5 wherein the maximum desired moisture content is not more than 15%.

7. The EMW treatment method of claim 1 wherein said source of electromagnetic waves is a portable drying apparatus comprising at least one electromagnetic wave generation assembly and an electromagnetic wave applicator.

8. The EMW treatment method of claim 7 wherein said electromagnetic wave applicator has an axial length of not more than 914 mm (36 inches).

9. The EMW treatment method of claim 7 wherein said electromagnetic wave applicator has a 3-D geometry selected from cuboid, cylinder, pyramid, cone, triangular prism, arched prism, or hemisphere.

10. The EMW treatment method of claim 1 wherein said source of electromagnetic waves comprises two magnetrons.

11. An electromagnetic wave (EMW) treatment method for the In-situ reduction of moisture content in a structural member within a wood-frame construction, comprising the following sequence of steps:

a) Providing a stud wall comprising a combination of interconnected horizontal and vertical structural members b) Selecting one structural member to be treated from said combination of interconnected horizontal and vertical structural members c) Providing a source of electromagnetic waves d) Directing said electromagnetic waves to contact at least a portion of said one structural member for a drying period (D) of not more than 30 minutes e) Allowing said one structural member to rest for a resting period (R) of not more than 90 minutes, and f) Determining a post-resting period moisture content of said one structural member wherein steps a) through f) of said EMW treatment method are repeated until the post-resting moisture content of said one structural member is not more than 19%.

12. The EMW treatment method of claim 11 wherein said one structural member is a vertical stud.

13. The EMW treatment method of claim 11 wherein said one structural member is a horizontal bottom plate.

14. The EMW treatment method of claim 11 wherein said one structural member is a horizontal header.

15. The EMW treatment method of claim 11 wherein said electromagnetic waves are provided at a frequency of from 100 MHz to 3000 MHz.

16. The EMW treatment method of claim 11 wherein said electromagnetic waves have a delivered EMW power (P) of from 0 to 10,000 Watts.

17. The EMW treatment method of claim 16 wherein said at least a portion of said one structural member has an axial length (X) of from 0 to 1220 millimeters.

18. The EMW treatment method of claim 17 wherein the drying period (D), in minutes, is defined by the relationship: D=13.1234(X)/(P) and the resting period (R), in minutes, is defined by the relationship: R=0.0656(X).

19. The EMW treatment method of claim 11 wherein said source of electromagnetic waves is a portable drying apparatus comprising at least one electromagnetic wave generation assembly and an electromagnetic wave applicator.

20. The EMW treatment method of claim 19 wherein said electromagnetic wave applicator has a 3-D geometry selected from cuboid, cylinder, pyramid, cone, triangular prism, arched prism, or hemisphere.

* * * * *